US010079476B2

(12) United States Patent
Kato

(10) Patent No.: US 10,079,476 B2
(45) Date of Patent: Sep. 18, 2018

(54) SPARK PLUG

(71) Applicant: NGK SPARK PLUG CO., LTD., Nagoya-shi, Aichi (JP)

(72) Inventor: Tomoaki Kato, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/376,904

(22) Filed: Dec. 13, 2016

(65) Prior Publication Data

US 2017/0179687 A1 Jun. 22, 2017

(30) Foreign Application Priority Data

Dec. 16, 2015 (JP) ..... 2015-244915

(51) Int. Cl.

| | |
|---|---|
| ***H01T 13/20*** | (2006.01) |
| ***H01T 13/40*** | (2006.01) |
| ***H01T 13/34*** | (2006.01) |
| ***H01T 13/41*** | (2006.01) |

(52) U.S. Cl.

CPC ..... *H01T 13/20* (2013.01); *H01T 13/34* (2013.01); *H01T 13/40* (2013.01); *H01T 13/41* (2013.01)

(58) Field of Classification Search

CPC ..... H01T 13/20; H01T 13/34
USPC ..... 313/141
See application file for complete search history.

(56) References Cited

U.S. PATENT DOCUMENTS

| | | | | |
|---|---|---|---|---|
| 5,008,584 A * | 4/1991 | Atsumi | H01T 13/41 252/503 |
| 6,583,537 B1 * | 6/2003 | Honda | H01T 13/41 313/135 |
| 2010/0264823 A1 | 10/2010 | Suzuki et al. | 315/71 |
| 2012/0169207 A1 | 7/2012 | Kato | 313/141 |

(Continued)

FOREIGN PATENT DOCUMENTS

| | | | |
|---|---|---|---|
| EP | 2903105 A1 | 8/2015 | H01T 13/20 |
| JP | H09-063745 A | 3/1997 | H01T 13/20 |

(Continued)

OTHER PUBLICATIONS

Extended European Search Report issued in corresponding European Patent Application No. 16203486.2, dated Mar. 30, 2017.

(Continued)

*Primary Examiner* — Christopher Raabe
(74) *Attorney, Agent, or Firm* — Kusner & Jaffe

(57) ABSTRACT

A spark plug has an insulator, a center electrode disposed in an axial hole, a resistor disposed in the axial hole and a seal member disposed between the resistor and the center electrode in the axial hole. The insulator includes an inner-diameter decreasing portion and a small inner-diameter portion. The center electrode includes a head portion supported on the inner-diameter decreasing portion of the insulator. The spark plug satisfies the following conditions: 1.8 mm≤L; and Cp≤11 mm where, assuming a region of the insulator from a boundary of the inner-diameter decreasing portion and the small inner-diameter portion to a rear end of the seal member as a specific region, L is a length of the specific region; D1 is an average inner diameter of the axial hole within the specific region; D2 is an average outer diameter of the specific region; and Cp is L/log(D2/D1).

3 Claims, 2 Drawing Sheets

(56) References Cited

U.S. PATENT DOCUMENTS

| | | | | |
|---|---|---|---|---|
| 2013/0175922 | A1* | 7/2013 | Yoshida | H01T 13/20 315/58 |
| 2013/0187531 | A1* | 7/2013 | Yoshida | H01T 13/20 313/143 |
| 2015/0263490 | A1 | 9/2015 | Mizuno et al. | H01T 13/40 |

FOREIGN PATENT DOCUMENTS

| | | | | |
|---|---|---|---|---|
| JP | 2009-245716 | A | 10/2009 | H01T 13/20 |
| WO | WO 2011/033902 | A1 | 3/2011 | H01T 13/20 |

OTHER PUBLICATIONS

Japanese Industrial Standard, JIS B 8031: 2006; Internal Combustion Engines—Spark-plugs.

* cited by examiner

SPARK PLUG

FIELD OF THE INVENTION

The present invention relates to a spark plug.

BACKGROUND OF THE INVENTION

A spark plug is conventionally used for an internal combustion engine. In general, the spark plug has a center electrode and a ground electrode to ignite an air-fuel mixture by the generation of a spark discharge within a gap between the center electrode and the ground electrode as disclosed in international Publication No. 2011/033902, Japanese Laid-Open Patent Publication No. 2009-245716, Japanese Laid-Open Patent Publication No. H09-63745 etc.

Recently, there has been a demand to increase the compression ratio of the air-fuel mixture in the internal combustion engine for the purpose of improvements in engine performance such as fuel efficiency. In such an internal combustion engine, the voltage applied to the spark plug increases with increase in compression ratio. The higher the voltage applied to the spark plug, the larger the amount of current flowing through the spark plug at the spark discharge. This leads to wear of the electrodes.

In view of the above circumstance, an advantage of the present invention is a spark plug capable of suppressing electrode wear.

SUMMARY OF THE INVENTION

The present invention can be embodied as the following application examples (1), (2) and (3). Hereinafter, the term "front" refers to a spark discharge side with respect to the direction of an axis of a spark plug; and the term "rear" refers to a side opposite the front side.

(1) According to one aspect of the present invention, there is provided a spark plug comprising: an insulator having an axial hole formed therein in a direction of an axis of the spark plug; a center electrode disposed in the axial hole, with a front end portion of the center electrode protruding from a front end of the insulator; a resistor disposed in the axial hole at a position closer to a rear end of the spark plug than the center electrode; and a seal member disposed in the axial hole at a position between the resistor and the center electrode so as to connect the resistor and the center electrode to each other, wherein the insulator includes: an inner-diameter decreasing portion having an inner diameter decreasing toward a front end of the spark plug; and a small inner-diameter portion located closer to the front end of the spark plug than the inner-diameter decreasing portion; Wherein the center electrode includes a head portion located at a position closer to the rear end of the spark plug than the small inner-diameter portion of the insulator and supported on the inner-diameter decreasing portion of the insulator; and wherein the spark plug satisfies the following conditions: 1.8 mm≤L; and Cp≤11 mm where, assuming a region of the insulator extending from a boundary of the inner-diameter decreasing portion and the small inner-diameter portion to a rear end of the seal member in the direction of the axis as a specific region, L is a length of the specific region in the direction of the axis; D1 is an average inner diameter of the axial hole within the specific region; D2 is an average outer diameter of the specific region; and Cp is a value given by L/log(D2/D1).

In the spark plug, a part of the insulator surrounding the seal member constitutes a capacitor. By satisfaction of the above specific conditions, it is possible to limit the capacitance of the capacitor and thereby possible to suppress wear of the electrode caused due to spark discharge and improve the durability of the spark plug.

(2) in accordance to a second aspect of the present invention, there is provided a spark plug as described above, wherein the spark plug preferably satisfies the following condition: 2.0≤M/S≤3.0 where S is a maximum cross-sectional area of the axial hole within the specific region as taken perpendicular to the axis; and M is an area of contact between the seal member and the center electrode.

In this case, it is possible to suppress wear of the electrode caused due to spark discharge and improve the durability of the spark plug by optimizing the maximum cross-sectional area S of the axial hole and the contact area M of the seal member and the center electrode.

(3) In accordance to a third aspect of the present invention, there is provided a spark plug as described above, wherein the spark plug preferably satisfies the following condition: D1≤1 mm.

In this case, it is possible to properly limit the capacitance of the capacitor and effectively suppress wear of the electrode caused due to spark discharge by setting the average inner diameter D1 of the axial hole to a small value.

It is herein noted that the present invention can be embodied in various forms such as not only a spark plug but also an internal combustion engine with a spark plug.

Other advantages and features of the present invention will also become understood from the following description.

DETAILED DESCRIPTION OF THE PREFERRED EMBODIMENTS

The present invention will be described below with reference to the drawings.

A. Embodiment

A-1. Structure of Spark Plug

Figure 1:
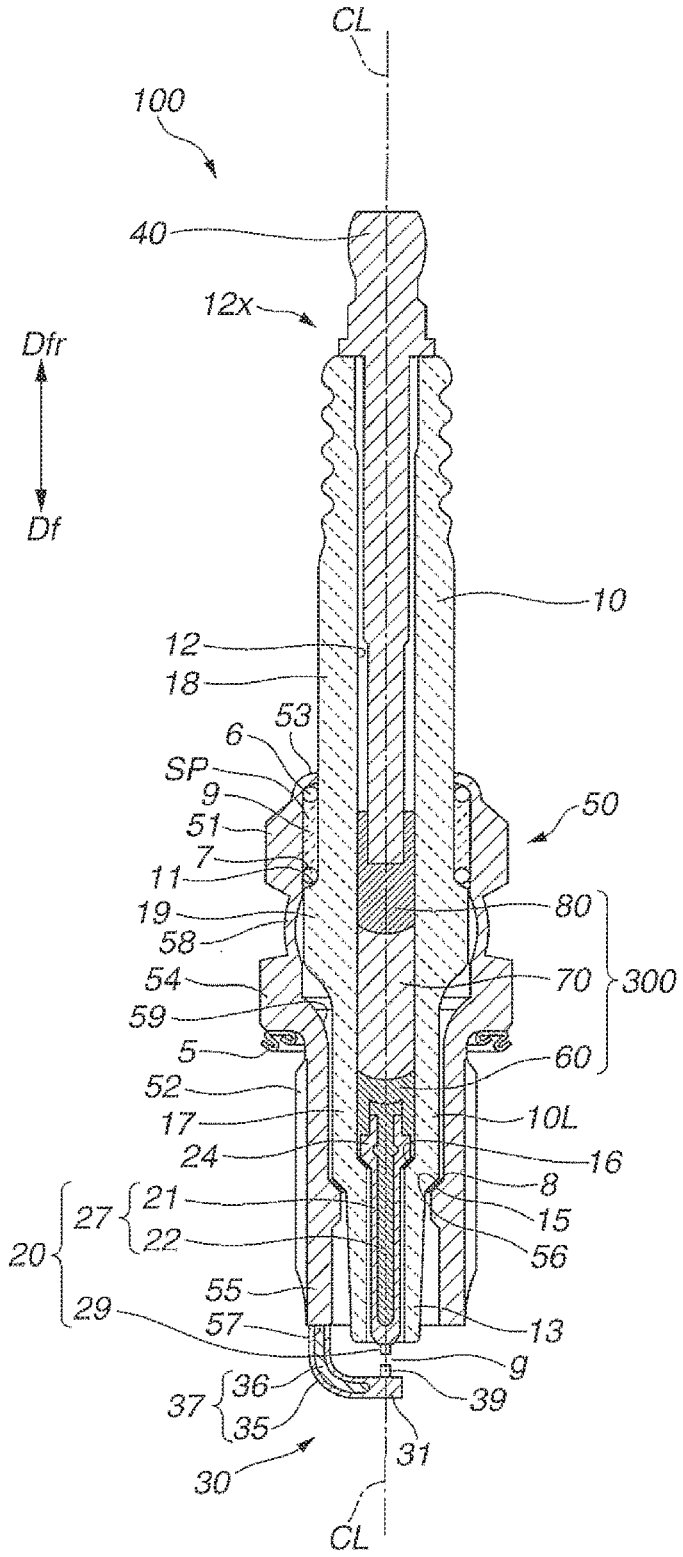
FIG. 1 is a cross-sectional view of a spark plug according to one embodiment of the present invention.

FIG. 1 is a cross-sectional view of a spark plug 100 for an internal combustion engine, such as gasoline engine, according to one embodiment of the present invention. In FIG. 1, a flat cross section of the spark plug 100 is taken along a center axis CL of the spark plug 100. Hereinafter, the direction parallel to the axis CL is referred to as the "direction of the axis CL" or simply referred to as the "axis direction". The radial direction of a circle about the axis CL is simply referred to as the "radius direction". The circumferential direction of a circle about the axis CL is simply referred to as the "circumferential direction". In FIG. 1, the front side is indicated by an arrow "Df"; and the rear side is indicated by an arrow Dfr.

As shown in FIG. 1, the spark plug 100 includes a substantially cylindrical insulator 10 having an axial hole 12 formed therein along the axis CL, a center electrode 20 disposed in a front end part of the axial hole 12, a metal terminal 40 disposed in a rear end part of the axial hole 12, a connection part 300 disposed between the center electrode 20 and the metal terminal 40 within the axial hole 12, a metal shell 50 fixed around an outer circumference of the insulator 10 and a ground electrode 30 having a base end joined to a front end face 57 of the metal shell 50 and a distal end facing the center electrode 20 with a gap g left therebetween.

The insulator 10 includes a large diameter portion 19, a front body portion 17, a first outer-diameter decreasing portion 15, a leg portion 13, a second outer-diameter decreasing portion 11 and a rear body portion 18. The large diameter portion 19 has the largest outer diameter among the respective portions of the insulator 10. The front body portion 17, the first outer-diameter decreasing portion 15 and the leg portion 13 are arranged in this order on the front side with respect the large diameter portion 19. The first outer-diameter decreasing portion 15 has an outer diameter gradually decreasing toward the front. The second outer-diameter decreasing portion 11 and the rear body portion 18 are arranged in this order on the rear side with respect to the large diameter portion 19. The second outer-diameter decreasing portion 11 has an outer diameter gradually decreasing toward the rear. Further, the insulator 10 has an inner-diameter decreasing portion 16 formed in the vicinity of the first outer-diameter decreasing portion 15 (in the present embodiment, in the front body portion 17). The inner-diameter decreasing portion 16 has an inner diameter gradually decreasing toward the front. Preferably, the insulator 10 is made of a material having mechanical strength, thermal strength, electrical strength etc. As such an insulator material, there can be used an alumina-based sintered ceramic material. It is needless to say that any other insulating material may alternatively be used as the material of the insulator 10.

The center electrode 20 has a rod-shaped electrode body 27 extending along the axis CL and a first tip 29 fixed to a front end of the electrode body 27 by e.g., laser welding. A head portion 24 of large diameter is formed on a rear part of the electrode body 27. In the present embodiment, the maximum outer diameter of the head portion 24 is set larger than the inner diameter of the leg portion 13 of the insulator 10. A front side surface of the head portion 24 is supported on the inner-diameter decreasing portion of the insulator 10. The center electrode 20 is disposed in the front end part of the axial hole 12 of the insulator 10, with a front end portion of the center electrode 20 protruding toward the front from a front end of the insulator 10. In the present embodiment, the electrode body 27 has an outer layer 21 and a core 22 located inside the outer layer 21. The outer layer 21 is made of e.g. a nickel-based alloy. The core 22 is made of a material (e.g. copper-based alloy) having higher thermal conductivity than that of the outer layer 21. The first tip 29 is made of a material (e.g. noble metal such as iridium (Ir) or platinum (Pt), tungsten (W), or an alloy of at least one thereof) having higher spark resistance than that of the electrode body 27.

The metal terminal 40 is disposed in the rear end part of the axial hole 12 of the insulator 10, with a rear end portion of the metal terminal 40 protruding toward the rear from a rear end of the insulator 10. The metal shell 40 is rod-shaped along the axis CL and is made of a conductive material (e.g. metal such as low carbon steel).

For suppression of electrical noise, a substantially cylindrical column-shaped resistor 70 is disposed between the metal terminal 40 and the center electrode 20 (i.e. at a position closer to the rear end of the spark plug 100 than the center electrode 20) within the axial hole 12 of the insulator 10. The resistor 70 is made of a composition containing a conductive material (e.g. carbon particles), ceramic particles (e.g. $ZrO_2$ particles) and glass particles (e.g. $SiO_2$—$B_2O_3$—$Li_2O$—BaO glass particles).

A first conductive seal member 60 is arranged between the resistor 70 and the center electrode 20, whereas a second conductive seal member 80 is arranged between the resistor 70 and the metal terminal 40. The seal member 60, 80 is made of a composition containing metal particles (e.g. Cu particles) and glass particles of the same kind as those contained in the resistor 70.

The center electrode 20 and the metal terminal 40 are electrically connected to each other via the resistor 70 and the seal members 60 and 80. Thus, these conductive members 60, 70 and 80 function together as the electrical connection part 300. In the present embodiment, the first seal member 60 corresponds to the claimed seal member.

The metal shell 50 has a substantially cylindrical shape with a through hole 59 along the axis CL such that the insulator 10 is inserted through the through hole 59 of the metal shell 50. The metal shell 50 is made of a conductive material (e.g. metal such as low carbon steel) and is fixed around the outer circumference of the insulator 10, with a front end portion of the insulator 10 protruding toward the front from a front end of the metal shell 50 and a rear end portion of the insulator 10 protruding toward the rear from a rear end of the metal shell 50.

The metal shell 50 includes a shell body 55 formed with a thread portion 52 for screwing into a mounting hole of the internal combustion engine and a seat portion 54 located on the rear side of the shell body 55. An annular gasket 5 is fitted between the thread portion 52 and the seal portion 54. The metal shell 50 also includes a deformation portion 58, a tool engagement portion 51 and a crimp portion 53 arranged in this order on the rear side with respect to the seal portion 54. The deformation portion 58 is deformed in such a shape that a middle of the deformation portion 58 projects radially outwardly (i.e., in a direction apart from the axis CL). The tool engagement portion 51 is formed into e.g. a hexagonal column shape so as to be engageable with a spark plug wrench. The crimp portion 53 is formed in a radially inwardly bent shape. In the present embodiment, the crimp portion 53 is located at a position closer to the rear end of the spark plug 100 than the second outer-diameter decreasing portion 11 of the insulator 10.

There is a space SP defined by an inner circumferential surface of the metal shell 50 and an outer circumferential surface of the insulator 10 at a location between the crimp portion 53 of the metal shell 50 and the second outer-diameter decreasing portion 11 of the insulator 10. A first rear-side packing 6, a talc (talc powder) 9 and a second rear-side packing 7 are disposed, in this order from the rear toward the front, within the space SP. In the present embodiment, the packing 6, 7 is in the form of a C-ring of iron. It is needless to say that the packing 6, 7 may be made of any other material.

Furthermore, the metal shell 50 includes an inner-diameter decreasing portion 56 formed on the shell body 55 and having an inner diameter gradually decreasing toward the front. A front-side packing 8 is disposed between the inner-diameter decreasing portion 56 of the metal shell 50 and the first outer-diameter decreasing portion 15 of the insulator 10. The packing 8 is also in the form of a C-ring of iron in the present embodiment. It is needless to say that the packing 8 may be made of any other material (e.g. metal such as copper).

During manufacturing of the spark plug 100, the crimp portion 53 is crimped toward the insulator 10 so as to be radially inwardly bent while being pressed toward the front. By such crimping, the deformation portion 58 is compressed and deformed. The insulator 10 is then pressed toward the front in the metal shell 50 via the rear-side packings 6 and 7 and the talc 9. The front-side packing 8 is consequently compressed between the first outer-diameter decreasing portion 15 and the inner-diameter decreasing portion to establish a seal between the metal shell 50 and the insulator 10. In this way, the metal shell 50 is fixed around the insulator 10 so as to prevent combustion gas from leaking from a combustion chamber of the internal combustion engine to the outside through between the metal shell and the insulator 10.

The ground electrode 30 has a rod-shaped electrode body 37 joined at a base end portion thereof to the front end face 57 of the metal shell 50 by e.g. resistance welding and a second tip 39 fixed to a distal end portion of the electrode body 37 by e.g. laser welding. The electrode body 37 extends from the metal shell 50 toward the front and then gets bent toward the axis CL such that the distal end portion 31 of the electrode body 37 faces the front end portion of the center electrode 20. Accordingly, the first tip 29 of the center electrode 20 and the second tip 39 of the ground electrode 30 face each other via the gap g. In the present embodiment, the electrode body 37 has an electrode base 35 defining a surface of the electrode body 37 and a core 36 embedded in the electrode base 35. The electrode base 35 is made of a material (e.g. nickel alloy) having higher oxidation resistance than that of the core 36. The core 36 is made of a material (e.g. pure copper, copper alloy etc.) having higher thermal conductivity than that of the electrode base 35.

The spark plug 100 can be manufactured by the following procedure. The insulator 10, the center electrode 20, the metal terminal 40, the metal shell 50, the material compositions of the seal members 60 and 80 and the material composition of the resistor 70 are prepared. The center electrode 20 is inserted into the axial hole 12 of the insulator 10 from a rear end opening 12*x* of the axial hole 12 and arranged at a predetermined position within the axial hole 12 by engagement of the head portion 24 of the center electrode 20 on the inner-diameter decreasing portion 16 of the insulator 10 as mentioned above with reference to FIG. 1. The material composition of the first seal member 60, the material composition of the resistor 70 and the material composition of the second seal member 80 are, in this order, put into the axial hole 12 from the rear end opening 12*x* and compacted/molded by insertion of a rod in the axial hole 12 from the rear end opening 12*x*. After that, a part of the metal terminal 40 is inserted in the axial hole 12 from the rear end opening 12*x*. In this state, the insulator 10 is heated at a predetermined temperature higher than the softening points of the glass components of the respective material compositions while the metal terminal 40 is pushed toward the front. As a result, the material compositions are compressed and sintered to respectively form the seal members 60 and 80 and the resistor 70. On the other hand, the ground electrode 30 is joined to the metal shell 50. The metal shell 50 to which the ground electrode 30 has been joined is then fixed around the insulator 10. Finally, the spark plug 100 is completed by bending the ground electrode 30.

A-2. Specific Region of Insulator

Figure 2:
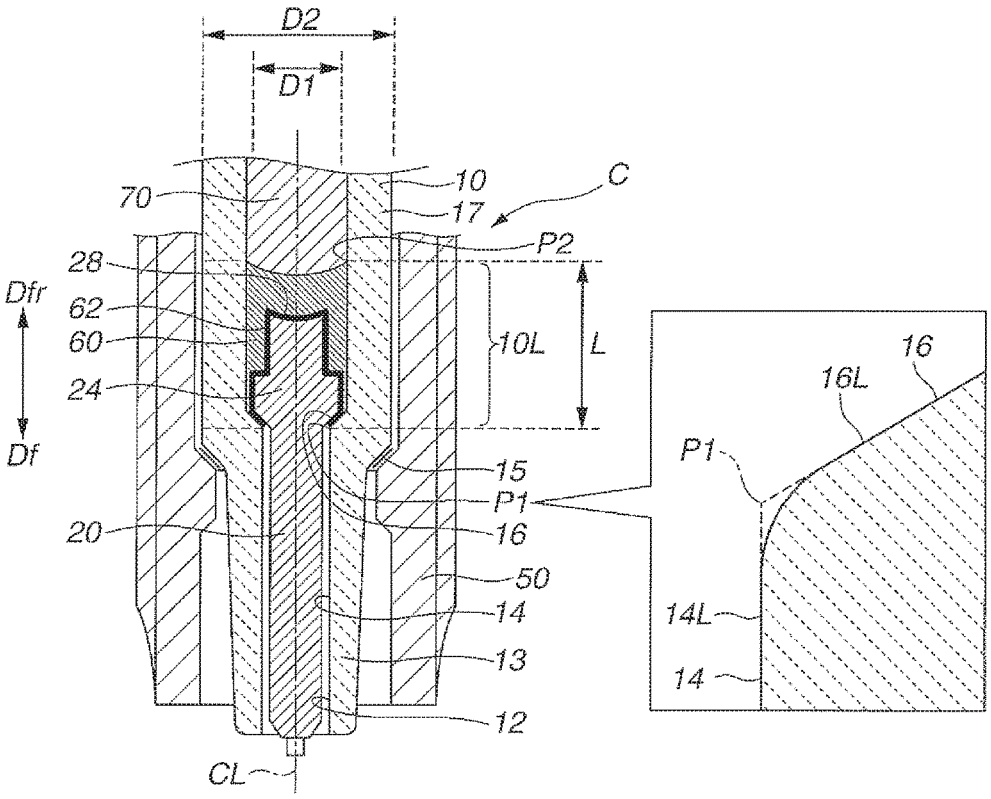
FIG. 2 is an enlarged cross-sectional view of a substantive part of the spark plug according to the one embodiment of the present invention.

FIG. 2 is an enlarged cross-sectional view of a substantive part of the spark plug 100 in the vicinity of the first seal member 60. In FIG. 2, the center electrode 20, a part of the insulator 10, the first seal member 60, a part of the resistor 70 and a part of the metal shell 50 are illustrated; and the ground electrode 30 is omitted from illustration. Further, the inner structure of the center electrode 20 is omitted from illustration.

As shown in FIG. 2, the insulator 10 includes a small inner-diameter portion 14 connected to a front end of the inner-diameter decreasing portion 16 (i.e. located at a position closer to the front end of the spark plug 100 than the inner-diameter decreasing portion 16) in the present embodiment. The small inner-diameter portion 14 has an inner diameter smaller than that of the inner-diameter decreasing portion 16. An inner circumferential surface of the small inner-diameter portion 14 is approximately in parallel with the axis CL.

Herein, a region of the insulator 10 surrounding the first seal member 60 is defined as a specific region 10L as shown in FIG. 2. More specifically, the specific region 10L of the insulator 10 is defined as extending from a boundary P1 of the inner-diameter decreasing portion 16 and the small inner-diameter portion 14 to a rear end P2 of the first seal member 60 in the direction of the axis CL (e.g. extending between broken lines in FIG. 2). The vicinity of the boundary P1 is shown in enlargement in the balloon of FIG. 2. As shown in the figure, the connection area between the inner-diameter decreasing portion 16 and the small inner-diameter portion 14 may be chamfered. In this case, the boundary P1 is defined as, in a flat cross section of the insulator 10 taken through the axis CL, an intersection between the extension of a straight line segment 16L representing the inner circumferential surface of the inner-diameter decreasing portion 16 and the extension of a straight line segment 14L representing the inner circumferential surface of the small inner-diameter portion 14.

The first seal member 60 is situated inside the specific region 10L. By contrast, the metal shell 50 is situated outside the specific region 10L (i.e., the specific region 10L is surrounded by the metal shell 50). In such a configuration, the first seal member 60 and the metal shell 50 form a capacitor C across the specific region 10L. When a high voltage is applied to the spark plug 100, the capacitor C accumulates electric charge according to the applied voltage before the generation of a spark discharge. The electric charge accumulated in the capacitor C flows as electric current at the spark discharge. This electric current flows from the center electrode 20 to the ground electrode 30 without being regulated by the resistor 70 because the resistor 70 lies on the rear side with respect to the first seal member 60. There is thus a large current flow caused between the electrodes 20 and 30 at the spark discharge in the case where the capacitance of the capacitor C is high. It is more likely that wear of the electrode 20, 30 will occur due to such a large current flow.

The capacitance of the capacitor C can be determined as follows by approximating the shape of the specific region 10L to a cylindrical shape with the assumption that the clearance between the specific region 10L and the metal shell 50 is sufficiently small.

As shown in FIG. 2, it is defined that: L is a length of the specific region 10L in the direction of the axis CL; D1 is an average inner diameter of the axial hole 12 within the specific region 10L; and D2 is an average outer diameter of the specific region 10L. The average inner diameter D1 refers to e.g. the average of a plurality of inner diameter values measured at intervals of 1 mm over the entire range from the front end to the rear end of the specific region 10L in the direction of the axis CL. Similarly, the average outer diameter D2 refers to e.g. the average of a plurality of outer diameter values measured at intervals of 1 mm over the entire range from the front end to the rear end of the specific region 10L in the direction of the axis CL. On the assumption that the cylindrical shape of the specific region 10L is represented by the length L, the average inner diameter D1 and the average outer diameter D2, the capacitance of the capacitor C is given by $2\pi\varepsilon L/\log(D2/D1)$ where the base of log is 10.

The value of $L/\log(D2/D1)$, which is the omission of the constant $2\pi\varepsilon$ from the expression $2\pi\varepsilon L/\log(D2/D1)$, is herein referred to as the "approximate capacitance evaluation value Cp" or "capacitance evaluation value Cp". The capacitance of the capacitor C is in proportion to the capacitance evaluation value Cp. Accordingly, the higher the capacitance evaluation value Cp, the larger the electric current caused at the spark discharge, the more likely wear of the electrode 20, 30 will occur. It is thus possible to suppress wear of the electrode 20, 30 by limiting the capacitance evaluation value Cp of the insulator 10 to a low value.

In view of the above fact, the spark plug 100 is adapted to satisfy the following specific conditions in the present embodiment (see the after-mentioned examples).

$$1.8\ \text{mm} \leq L$$

$$Cp \leq 11\ \text{mm}$$

It is preferable to satisfy the following condition: $D1 \leq 3$ mm in order to properly limit the capacitance of the capacitor C.

It is also defined that: M is an area of contact between the first seal member 60 and the center electrode 20 (as indicated by a thick line 62 in FIG. 2); and S is a maximum cross-sectional area of the axial hole 12 within the specific region 10L as taken perpendicular to the axis CL. The thick line 62 is hereinafter also referred to as "contact line 62".

In order to properly limit the capacitance of the capacitor C, it is further preferable to satisfy the following condition: $2.0 \leq M/S \leq 3.0$ by optimization of the maximum cross-sectional area S and the contact area M.

In the present embodiment, the center electrode 20 is symmetric in shape with respect to the axis CL. It means that the cross section of the center electrode 20 is substantially the same in shape as long as the cross section is taken through the axis CL (i.e. irrespective of the direction of the cross section). In this case, the contact line 62, when rotated 180° about the axis CL, outlines a three-dimensional shape which is well approximate to the shape of the contact area M. Namely, the area of the three-dimensional shape well approximates the contact area M.

The contact area M can be thus determined as follows based on the shape of the contact line 62.

For example, the contact line 62 is approximated to a bent line consisting of a plurality of straight line segments of predetermined length (e.g. 0.1 mm).

The areas defined by rotation of the respective line segments are calculated in the same manner as the calculation of a lateral surface area of a truncated cone. The sum of the calculated surface areas is determined as the contact area M. It is feasible to approximate the contact area line 60 to the bent line by any known method.

B. Evaluation Test

Fifteen types of samples of the spark plug 100 (sample No. 1 to 15) were produced and each tested by gap test and load lifetime test. The configurations and test results of the respective samples are shown in TABLE 1.

TABLE 1

| | | | | | Gap test | | Load lifetime |
|---|---|---|---|---|---|---|---|
| Sample No. | D1 (mm) | D2 (mm) | L (mm) | Cp (mm) | Reduction rate (%) of gap increase | Evaluation | test Evaluation |
| 1 | 3.9 | 7.3 | 5.0 | 18.4 | −5.0 | D | A |
| 2 | 3.9 | 7.3 | 4.0 | 14.7 | −3.3 | D | A |
| 3 | 3.9 | 9.2 | 5.0 | 13.4 | 0 | — | A |
| 4 | 2.7 | 7.6 | 5.0 | 11.1 | 8.3 | C | A |
| 5 | 3.9 | 7.3 | 3.0 | 11.0 | 13.3 | B | A |
| 6 | 3 | 7.7 | 4.5 | 11.0 | 16.7 | B | A |
| 7 | 3 | 7.3 | 4.0 | 10.4 | 18.3 | B | A |
| 8 | 3 | 7.6 | 4.0 | 9.9 | 20.0 | A | A |
| 9 | 3.9 | 7.3 | 2.0 | 7.3 | 21.7 | A | A |
| 10 | 3.9 | 9.2 | 2.0 | 5.4 | 26.7 | A | A |
| 11 | 3 | 6.5 | 1.8 | 5.4 | 30.0 | A | A |
| 12 | 2.7 | 6.3 | 2.0 | 5.4 | 33.3 | A | A |
| 13 | 3 | 7.6 | 2.0 | 5.0 | 35.0 | A | A |
| 14 | 3 | 6.3 | 1.5 | 4.7 | 35.0 | A | B |
| 15 | 3.9 | 9.2 | 1.3 | 3.5 | 36.7 | A | B |

In the samples No. 1 to 15, the parameters D1, D2, L and Cp were determined as defined above (see FIG. 2). These samples were different in at least one of the parameters D1, D2, L and Cp. The other configurations of the samples were common.

The gap test was performed as follows to test the gap increase reduction rate (%).

The test sample was placed in the air of 10 MPa pressure and allowed to repeat spark discharge a frequency of 60 for 20 hours. The gap g between the electrodes 20 and 30 was measured with a pin gauge before and after the repeated spark discharge cycles. The difference of these measurement results was calculated as the amount of increase of the gap g (i.e. the amount of wear of the electrode 20, 30). In this gap test, three samples was used for each sample type. The average of the calculated gap increase amount values of the three respective samples was adopted as the gap increase.

The rate of reduction of the gap increase was determined with reference to that of the sample No. 3 by the following formula.

$$\text{Gap increase reduction rate (\%)} = \frac{\{(\text{Gap increase of test sample}) - (\text{Gap increase of reference sample})\}}{(\text{Gap increase of reference sample})} \times 100$$

The positive value of the gap increase reduction rate means that the gas increase of the test sample was smaller than that of the reference sample (sample No. 3), that is, the wear of the electrode 20, 30 of the test sample was more suppressed as compared to that of the reference sample (sample No. 3). The lower the gap increase reduction rate, the smaller the gap increase, the more suppressed the wear of the electrode 20, 30.

The gap test result was evaluated as follows.

A: Gap increase reduction rate≥20%

B: 20%>Gap increase reduction rate≥10%

C: 10%>Gap increase reduction rate≥0%

D: 0%>Gap increase reduction rate

The load lifetime test was performed as follows according to the clauses 7.13 and 7.14 of JIS B 8031: 2006 "Internal Combustion Engines—Spark Plugs".

The resistance of the test sample was first measured according to the clause 7.13 of JIS B 8031. The test sample was then subjected to load test operation according to the clause 7.14 of JIS B 8031. In the load test operation, the test sample was allowed to repeat $1.3\times10^7$ times of spark discharge with the application of a voltage of 20 kV. The resistance of the test sample after the load test was measured according to the clause 7.13 of JIS B 8031. The rate of change of the resistance was determined by subtracting the resistance of the test sample before the load test from the resistance of the sample after the load test. In this load lifetime test, one sample was used for each sample type.

The load lifetime test result was evaluated as: A when the resistance change rate was in the proper range of −30% to +30%; and B when the resistance change rate was out of the proper range.

As shown in TABLE 1, the longer the length L of the specific region 10L, the better the load lifetime test result. The reason for this is assumed that, when the length L of the specific region 10L was long, the length of the first seal member 60 was long so that the first seal member 60 was improved in durability. The load lifetime test result was evaluated as A for the samples where the length L was 1.8 mm, 2.0 mm, 3.0 mm, 4.0 mm, 4.5 mm and 5.0 mm. It has thus been shown that it is possible to improve the durability of the spark plug by satisfaction of 1.8 mm≤L. It is feasible to use any of the above sixth length values other than 1.8 mm as the lower limit of the length L. Further, it is feasible to use any one of the above sixth length values as the upper limit of the length L. For example, the length L may be set shorter than or equal to 5.0 mm. It is needless to say that the length L may be set shorter than 5.0 mm.

Furthermore, the lower the capacitance evaluation value Cp, the better the gap test result, as shown in TABLE 1. The reason for this is assumed that the current flow between the electrodes 20 and 30 was more suppressed when the capacitance evaluation value Cp was low than when the capacitance evaluation value Cp was high as mentioned above. The gap test result was evaluated as A or B for the samples where the capacitance evaluation value Cp was 3.5 mm, 4.7 mm, 5.0 mm, 5.4 mm, 7.3 mm, 9.9 mm, 10.4 mm and 11.0 mm. It has thus been shown that it is possible to suppress the wear of the electrode 20, 30 by satisfaction of Cp≤11.0 mm. It is feasible to use any of the above eight capacitance evaluation values other than 11.0 mm as the upper limit of the capacitance evaluation value Cp. It is further feasible to use any one of the above eight capacitance evaluation values as the lower limit of the capacitance evaluation value Cp. For example, the capacitance evaluation value Cp may be set higher than or equal to 3.5 mm. It is needless to say that the capacitance evaluation value Cp may be set lower than 3.5 mm.

Regardless of the shape of the specific region 10L, the gap test result was favorable as long as the capacitance evaluation value Cp was lower than or equal to 11.0 mm. It is thus considered that, when the capacitance evaluation value Cp is lower than or equal to 11.0 mm, the amount of electric charge accumulated in the capacitor C is decreased to limit the flow of electric current between the electrodes 20 and 30 at the spark discharge and thereby suppress the wear of the electrode 20, 30 regardless of the average inner and outer diameters D1 and D2. The average inner diameter D1 may be thus within or out of the range of D1 of the fifteen test samples (i.e. the range from 2.7 mm to 3.9 mm). Likewise, the average outer diameter D2 may be within or out of the range of D2 of the fifteen test samples (i.e. the range from 6.3 mm to 9.2 mm). However, it is apparent that it is preferable to satisfy D1≤3 mm in view of the fact that the gap test result was better when the average inner diameter D1 was smaller than or equal to 3 mm as shown in TABLE 1.

Next, ten types of other samples of the spark plug 100 (sample No. 16 to 25) were produced and each tested by impact resistance test and productivity test. The configurations and test results of the respective samples are shown in TABLE 2.

TABLE 2

| Sample No. | M ($mm^2$) | S ($mm^2$) | M/S | Impact resistance test Evaluation | Productivity test (n = 30) Number of defective products | Productivity test (n = 30) Evaluation |
|---|---|---|---|---|---|---|
| 16 | 21.9 | 11.9 | 1.8 | B | 0 | A |
| 17 | 22.7 | 11.9 | 1.9 | B | 0 | A |
| 18 | 24.2 | 11.9 | 2.0 | A | 0 | A |
| 19 | 30.1 | 11.9 | 2.5 | A | 0 | A |
| 20 | 33.7 | 11.9 | 2.8 | A | 1 | B |
| 21 | 35.6 | 11.9 | 3.0 | A | 1 | B |
| 22 | 36.4 | 11.9 | 3.1 | A | 4 | C |
| 23 | 13.6 | 7.1 | 1.9 | B | 0 | A |
| 24 | 19.4 | 7.1 | 2.7 | A | 1 | B |
| 25 | 22.8 | 7.1 | 3.2 | A | 5 | C |

In the samples No. 16 to 25, the parameters M, S and M/S were determined as defined above (see FIG. 2). Among these ten types of samples, each of seven samples No. 16 to 22 had the same configurations as those of sample No. 10 of TABLE 1, except for the shape of the rear end face 28 of the center electrode 20. The parameters D1, D2 and L of sample No. 16 to 22 were the same as those of sample No. 10. (The parameters M, S and M/S of sample No. 16 were the same as those of sample No. 10.) Each of three samples No. 23 to 25 had the same configurations as those of sample No. 11 of TABLE 1, except for the shape of the rear end face 28 of the center electrode 20. The parameters D1, D2 and L of sample No. 23 to 25 were the same as those of sample No. 11. (The parameters M, S and M/S of sample No. 23 were the same as those of sample No. 11.) The shape of the rear end face 28 of the center electrode 20 was changed to vary the contact area M. In each sample, the rear end face 28 of the center electrode 20 was depressed toward the front. The contact area M was varied by adjusting the amount of depression of the rear end face 28 of the center electrode 20.

The impact resistance test was performed as follows.

The test sample was subjected to the same test operation as in the gap test. After that, the test sample was subjected to impact resistance test operation three times according to the clause 7.4 of JIS B 8031. The test sample was then tested for whether or not the center electrode 20 was firmly fixed in position relative to the insulator 10.

The impact resistance result was evaluated as: A when the center electrode 20 was firmly fixed in position relative to the insulator 10; and B when the center electrode 20 was movable relative to the insulator 10.

The productivity test was performed by counting the number of occurrence of defective samples during production of thirty test samples. Herein, the sample was judged as defective when the electrical resistance between the center electrode 20 and the metal terminal 40 was higher than a threshold value. The threshold value was set as a value higher than the upper limit of a predetermined proper resistance range.

The productivity test result was evaluated as: A when the number of occurrence of defective samples was 0 (zero); B when the number of occurrence of defective samples was 1; and C when the number of occurrence of defective samples was 2 or more.

As shown in TABLE 2, the higher the ratio M/S, the better the impact resistance test result. The reason for this is assumed that, when the ratio M/S was high, the contact area M between the first seal member 60 and the center electrode 20 was large relative to the respective outer diameters of the center electrode 20 and the first seal member 60 so that the adhesion of the center electrode 20 and the first seal member 60 was improved. The impact resistance test result was evaluated as A for the samples where the ratio M/S was 2.0, 2.5, 2.7, 2.8, 3.0, 3.1 and 3.2. It has thus been shown that the ratio M/S is preferably higher than or equal to 2.0. It is feasible to use any arbitrary one of the above seven ratio values higher than 2.0 as the lower limit of the ratio M/S.

On the other hand, the lower the ratio M/S, the better the productivity rest result, as shown in TABLE 2. The reason for this is assumed as follows. The rear end face 28 of the center electrode 20 was more depressed when the ratio M/S was high than when the ratio M/S was low. As the rear end face 28 of the center electrode 20 was more depressed, it was difficult to introduce the material of the first seal member 60 to the bottom of the depressed rear end face 28 of the center electrode 20 so that there was a clearance formed between the center electrode 20 and the first seal member 60. The formation of such a clearance became a cause of poor conduction between the center electrode 20 and the first seal member 60. The productivity test result was evaluated as A for the samples where the ratio M/S was 1.8, 1.9, 2.0, 2.5, 2.7, 2.8 and 3.0. It has thus been shown that the ratio M/S is preferably lower than or equal to 3.0. It is feasible to use any arbitrary one of the above seven ratio values lower than 3.0 as the upper limit of the ratio M/S.

Although the impact resistance and productivity of the spark plug were largely influenced by the contact area M between the first seal member 60 and the center electrode 20 as shown in TABLE 2, it is considered from the test results that the influence of the other factors (average inner diameter D1, average outer diameter D2 and length L) on the impact resistance and productivity of the spark plug is small. In fact, for example, both of the samples No. 16 to 22 and the samples No. 23 to 25 had high impact resistance and productivity even though the average inner diameter D1, average outer diameter D2 and length L of the samples No. 16 to 22 (corresponding to those of the sample No. 10 of TABLE 1) were respectively different from the average inner diameter D1, average outer diameter D2 and length L of the samples No. 23 to 25 (corresponding to those of the sample No. 11 of TABLE 1). It is also considered that: when the ratio M/S is high, the impact resistance is improved as the adhesion of the center electrode 20 and the first seal member 60 is increased regardless of the shape of the surface of the center electrode 20 in contact with the first seal member 60; and, when the ratio M/S is low, the productivity is improved as it becomes less difficult to introduce the material of the first seal member 60 to the surface of the center electrode 20. The above preferable range of the ratio M/S is thus applicable to varying combinations of D1, D2 and L and to varying shapes of the surface of the center electrode 20 in contact with the first seal member 60. It is needless to say that the ratio M/S may be out of the above preferable range.

C. Modifications

The configurations of the spark plug 100 are not limited to those of FIGS. 1 and 2. Although a part of the specific region 10L of the insulator 10 located rear of the inner-diameter decreasing portion 16 is made constant in inner diameter in the above embodiment, the specific region 10L of the insulator 10 is not limited to such a diameter. The inner diameter of the part of the specific region 10L of the insulator 10 located rear of the inner-diameter decreasing portion 16 may be changed depending on the position in the direction of the axis CL. The outer diameter of the specific region 10L of the insulator 10 may be changed depending on the position in the direction of the axis CL. Further, the inner and outer circumferential surfaces of the specific region 10 of the insulator 10 may be different in shape. In this way, it is feasible to change the size of the clearance between the specific region 10L and the metal shell 50 depending on the position in the direction of the axis CL. In general, the capacitance of the capacitor C is lower than the value of $2\pi\varepsilon L/\log(D2/D1)$ when the clearance between the specific region 10L and the metal shell 50 is larger than 0 (zero). It is thus possible to, as long as the capacitance resistance value Cp ($=L/\log(D2/D1)$), suppress wear of the electrode 20, 30 even though the respective configurations of the insulator 10 and the metal shell 50 (in particular, the specific region 10L of the insulator 10 and the part of the metal shell 50 facing the specific region 10) are different from those of the above embodiment.

A part of the surface of the center electrode 20 in contact with the first seal member 60 may be knurled or be formed with either or both of pits and projections for increase of the contact area M.

The spark discharge gap g may be defined between the a side surface of the center electrode 20 (in parallel to the axis CL) and the ground electrode 30 rather than between the front end face of the center electrode 20 and the ground electrode 30.

The center electrode 20 may be of any shape other than that of the above embodiment. Likewise, the ground electrode 30 may be of any shape other than that of the above embodiment.

The entire contents of Japanese Patent Application No. 2015-244915 (filed on Dec. 16, 2015) are herein incorporated by reference.

Although the present invention has been described with reference to the above specific embodiments and modifications, the above embodiments and modifications are intended to facilitate understanding of the present invention and are not intended to limit the present invention thereto. Without departing from the scope of the present invention, various changes and modifications can be made to the present invention; and the present invention includes equivalents thereof. The scope of the invention is defined with reference to the following claims.

DESCRIPTION OF REFERENCE NUMERALS

5: Gasket
6: First rear-side packing
7: Second rear-side packing
8: Front-side packing
9: Talc
10: Insulator
10L: Specific region
11: Second outer-diameter decreasing portion
12: Axial hole
12*x*: Rear end opening
13: Leg portion
14: Small inner-diameter portion
14L: Straight line segment
15: First outer-diameter decreasing portion
16: Inner-diameter decreasing portion
16L: Straight line segment
17: Front body portion
18: Rear body portion
19: Large diameter portion
20: Center electrode
21: Outer layer
22: Core
24: Head portion
27: Electrode body
28: Rear end face
29: First tip
30: Ground electrode
31: Distal end portion
35: Electrode base
36: Core
37: Electrode body
39: Second tip
40: Metal terminal
50: Metal shell
51: Tool engagement portion
52: Thread portion
53: Crimp portion
54: Seat portion
55: Body part
56: Inner-diameter decreasing portion
57: Front end face
58: Deformation portion
59: Through hole
60: First seal member
62: Contact line
70: Resistor
80: Second seal member
100: Spark plug
300: Connection part
g: Gap
C: Capacitor
CL: Axis
SP: Space
Df: Front side
Dfr: Rear side Having described the invention, the following is claimed:

1. A spark plug comprising:

an insulator having an axial hole formed therein in a direction of an axis of the spark plug;

a center electrode disposed in the axial hole, with a front end portion of the center electrode protruding from a front end of the insulator;

a resistor disposed in the axial hole at a position closer to a rear end of the spark plug than the center electrode; and a seal member disposed in the axial hole at a position between the resistor and the center electrode so as to connect the resistor and the center electrode to each other, wherein the insulator includes: an inner-diameter decreasing portion having an inner diameter decreasing toward a front end of the spark plug; and a small inner-diameter portion located closer to the front end of the spark plug than the inner-diameter decreasing portion;

wherein the center electrode includes a head portion located at a position closer to the rear end of the spark plug than the small inner-diameter portion of the insulator and supported on the inner-diameter decreasing portion of the insulator; and wherein the spark plug satisfies the following conditions: 1.8 mm≤L; and Cp≤11 mm where, assuming a region of the insulator extending from a boundary of the inner-diameter decreasing portion and the small inner-diameter portion to a rear end of the seal member in the direction of the axis as a specific region, L is a length of the specific region in the direction of the axis; D1 is an average inner diameter of the axial hole within the specific region; D2 is an average outer diameter of the specific region; and Cp is a value given by L/log(D2/D1).

2. The spark plug according to claim 1, wherein the spark plug satisfies the following condition: 2.0≤MIS≤3.0 where S is a maximum cross-sectional area of the axial hole within the specific region as taken perpendicular to the axis; and M is an area of contact between the seal member and the center electrode.

3. The spark plug according to claim 1 or 2, wherein the spark plug satisfies the following condition: D1≤3 mm.

* * * * *